US011072886B2

(12) United States Patent
Robertsén et al.

(10) Patent No.: US 11,072,886 B2
(45) Date of Patent: Jul. 27, 2021

(54) PROCESS FOR TREATING PULP

(71) Applicant: KEMIRA OYJ, Helsinki (FI)

(72) Inventors: Leif Robertsén, Parainen (FI); Veli-Matti Vuorenpalo, Espoo (FI); Anna-Maija Perander, Espoo (FI); Pentti Pekonen, Oulu (FI); Jonas Konn, Espoo (FI)

(73) Assignee: KEMIRA OYJ, Helsinki (FI)

( * ) Notice: Subject to any disclaimer, the term of this patent is extended or adjusted under 35 U.S.C. 154(b) by 83 days.

(21) Appl. No.: 16/311,213

(22) PCT Filed: Jun. 27, 2017

(86) PCT No.: PCT/FI2017/050480
§ 371 (c)(1),
(2) Date: Dec. 19, 2018

(87) PCT Pub. No.: WO2018/002434
PCT Pub. Date: Jan. 4, 2018

(65) Prior Publication Data

US 2019/0186075 A1 Jun. 20, 2019

(30) Foreign Application Priority Data

Jul. 1, 2016 (FI) ..... 20165548

(51) Int. Cl.
*D21C 9/16* (2006.01)
*D21C 9/10* (2006.01)

(52) U.S. Cl.
CPC ..... *D21C 9/166* (2013.01); *D21C 9/1036* (2013.01); *D21C 9/16* (2013.01); *D21C 9/163* (2013.01)

(58) Field of Classification Search
CPC ..... D21C 9/163; D21C 9/166
See application file for complete search history.

(56) References Cited

U.S. PATENT DOCUMENTS 5,431,781 A 7/1995 Walsh
5,464,501 A * 11/1995 Kogan ..... D21C 5/02 162/6
6,007,678 A 12/1999 Linsten et al.
2002/0193626 A1 12/2002 Pohjanvesi et al.

FOREIGN PATENT DOCUMENTS

CA 2127967 A1 1/1995
EP 0634521 A1 1/1995
EP 1247802 A1 10/2002
RU 2097462 C1 11/1997

(Continued)

OTHER PUBLICATIONS

Davies et al.,A Comparison of Options to Improve Brightness Stability of Chemical Pulp, 2009, Pulp and Paper Canada. (Year: 2009).*

(Continued)

*Primary Examiner* — Anthony Calandra
(74) *Attorney, Agent, or Firm* — Meunier Carlin & Curfman LLC

(57) ABSTRACT

The present invention relates to a process for treating pulp comprising a step, wherein the pulp is treated with distilled percarboxylic acid, such as distilled per-carboxylic acid (dPAA), and peroxide, such as hydrogen peroxide.

20 Claims, 4 Drawing Sheets

(56) References Cited

FOREIGN PATENT DOCUMENTS

| | | | |
|---|---|---|---|
| WO | 7900637 | A1 | 9/1979 |
| WO | 9823811 | A1 | 6/1998 |
| WO | 9932710 | A1 | 7/1999 |
| WO | 0052258 | A1 | 9/2000 |
| WO | 0077301 | A1 | 12/2000 |
| WO | 02052100 | A2 | 7/2002 |

OTHER PUBLICATIONS

Finnish Patent and Registration Office, Search report of Finnish application No. 20165548, dated Mar. 6, 2017, 2 pages.
Costa, M.M. et al., Possibilities and Gains for Peracetic Acid ECF Bleaching, Proceedings of eth ABTCP International Pulp and Paper Congress and VII Iberoamerican Congress on Pulp and Paper Research, Oct. 9-11, 2012. abstract, chapter 2: "Experimental".
Ni, Y., The Complementary Effects of Peracetic Acid and Hydrogen Peroxide in a TCF Bleaching Sequence, 1993 International pulp bleaching conference, Helsinki, Finland, Jun. 1-5, 1998, Book 2, poster presentations, pp. 509-514. chapter "Experimental", Table 1.
Barros, D.P., Effect of Last Stage Bleacing with Peracetic Acid on Brightness Development and Properties of Eucalyptus Pulp, Bioresources, vol. 5 nro. 2, pp. 881-898. chapter "experimental", Tables 1 and 2.

* cited by examiner

PROCESS FOR TREATING PULP

Priority

This application is a U.S. national application of PCT-application PCT/FI2017/050480 filed on Jun. 27, 2017 and claiming priority of Finnish application FI20165548 filed on Jul. 1, 2016, the contents of all of which are incorporated herein by reference.

FIELD OF THE INVENTION

The invention relates to a process for treating pulp.

BACKGROUND ART

Purpose of bleaching of pulp is to bring to completion, after the digestion, the removal of residual lignin from the pulp. Bleaching is currently often started with oxygen delignification, whereafter further bleaching can be carried out by various methods. In totally chlorine free (TCF) bleaching, delignification can be continued with, for example, ozone, peracetic acid or hydrogen peroxide in acid or alkaline conditions. In elemental chlorine free (ECF) bleaching, chlorine dioxide steps are used, with intermediate alkali steps. In ECF bleaching, increasingly often oxygen chemicals are used, i.e. oxygen, ozone, hydrogen peroxide and peracids such as peracetic acid, for promoting bleaching. For example, chlorine dioxide can be saved by the use of hydrogen peroxide in an ECF bleaching sequence. On the other hand, also for environmental reasons, efforts are being made to use increasingly smaller doses of chlorine dioxide in bleaching.

A pulp, such as chemical pulp, can be bleached to a degree of brightness of 85-90% ISO by, for example, a conventional ECF bleaching processes. Post-bleaching methods, such as post-bleaching with peracetic acid, are often used to even further raise the brightness of the pulp.

Peracetic acid (PAA) is a compound which forms when acetic acid and hydrogen peroxide react in the presence of a catalyst. There are various products commercially available, for example, 38 percent distilled peracetic acid (dPAA) and an equilibrium mixture of peracetic acid (ePAA), which typically contains peracetic acid approximately 20% by weight.

WO 00/52258 relates to a bleaching process. The multiple-step bleaching process for bleaching of a chemical cellulose pulp is disclosed, wherein as the last bleaching step the process comprises a post-bleaching wherein a delignified and bleached cellulose pulp is bleached with a percarboxylic acid.

Often with some pulps a sudden brightness drop occurs in the beginning of the bleaching step, such as post-bleaching step, when pulp is treated with per-carboxylic acids.

Therefore, there is a need for improved and more efficient process in which no brightness drop occurs when pulp is treated with percarboxylic acids.

SUMMARY OF INVENTION

An object of the present invention is to provide a process for treating pulp.

A further object of the present invention is to provide an improved and efficient process for treating pulp with percarboxylic acid.

Yet, a further object of the present invention is to provide a process for treating pulp with percarboxylic acid wherein brightness of the pulp increases.

Yet, another further object of the present invention is to provide a process for treating pulp with percarboxylic acid wherein no brightness drop of the pulp occurs.

It has now been surprisingly found that an addition of a small amount of peroxide to a process where pulp is treated with distilled percarboxylic acid prevents the sudden brightness drop experienced, for example, in the post-bleaching of pulps such as Kraft pulps. The peroxide is preferably hydrogen peroxide, and the distilled percarboxylic acid is preferably distilled peracetic acid (dPAA).

The brightness drop of pulp, that is darkening of pulp, is believed, without bounding to any theory, to be due to oxidation of manganese from colorless $Mn^{2+}$ to the black $Mn^{+}$ ($MnO_2$) in the pulp. A small addition of peroxide to the distilled percarboxylic acid is sufficient to alter the redox of the pulp suspension so that this oxidation is prevented.

The present invention provides a process for treating pulp.

DETAILED DESCRIPTION

Figure 1:
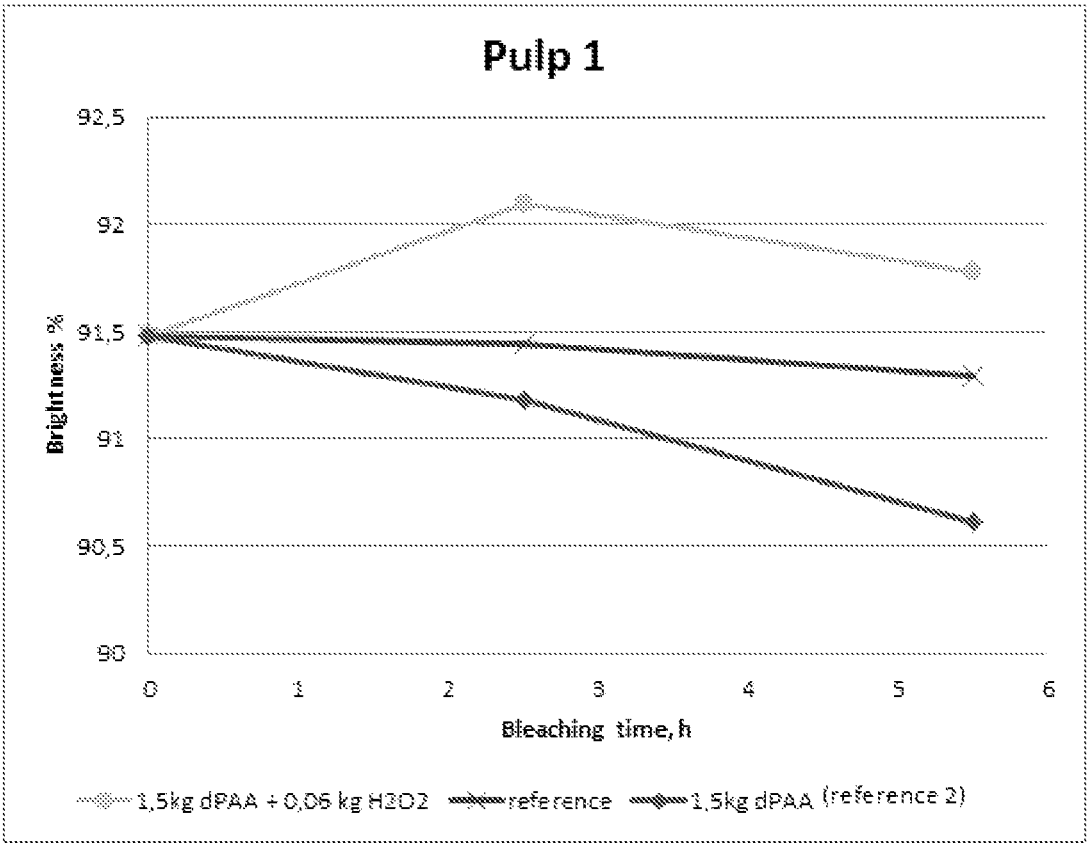
FIG. 1 shows brightness of pulps treated with the method according to the present invention and with reference methods.

According to the present invention there is provided a process for treating pulp. More particularly there is provided a process for treating pulp comprising a step, wherein the pulp is treated with distilled percarboxylic acid and peroxide.

The distilled percarboxylic acid may be any suitable distilled percarboxylic acid. In one embodiment the distilled percarboxylic acid is selected from distilled performic acid, distilled peracetic acid (dPAA), distilled perpropionic acid or a mixture thereof. Preferably the distilled percarboxylic acid is distilled peracetic acid (dPAA).

Distilled percarboxylic acids are commercially available. Distilled percarboxylic acids may also be manufactured with any suitable method in the art. As an example, process for producing dPAA is disclosed in publication US 2002/0193626 A1.

Distilled peracetic acid (dPAA) is obtained from the equilibrium solution of peracetic acid and hydrogen peroxide and acetic acid. The advantage of the distilled peracetic acid is the absence of acetic acid and hydrogen peroxide. The absence of acetic acid is a certain advantage due to lower content of volatile organic compounds introduced into the process.

In one embodiment peracetic acid (PAA) concentration in distilled peracetic acid (dPAA) is within range 10-70% by weight, preferably within range 30-60% by weight.

In another embodiment hydrogen peroxide concentration in the dPAA is equal or less than 1% by weight, preferably within range 0.1-0.5% by weight.

In another embodiment acetic acid concentration in the dPAA is equal or less than 1% by weight, preferably within the range 0.05-0.5% by weight.

In a preferred embodiment peracetic acid (PAA) concentration is within range 10-70% by weight, preferably within range 30-60% by weight; hydrogen peroxide concentration is equal or less than 1% by weight, preferably within range 0.1-0.5% by weight; and acetic acid concentration is equal or less than 1% by weight, preferably within the range 0.05-0.5% by weight in distilled peracetic acid (dPAA).

The peroxide may be any suitable peroxide. In one embodiment the peroxide is selected from hydrogen peroxide, percarbonate, or a mixture thereof. Preferably the peroxide is hydrogen peroxide.

Peroxides are commercially available. Peroxides may also be manufactured with any suitable method known in the art.

The pulp may be treated, together with the distilled percarboxylic acid, with a suitable composition that comprises peroxide. As an example, the pulp may be treated with an equilibrium solution of peracetic acid (ePAA), together with the distilled percarboxylic acid. The ePAA contains also hydrogen peroxide, because peracetic acid degrades partly to hydrogen peroxide to reach the equilibrium state. In one embodiment the hydrogen peroxide is added as an ePAA solution.

The pulp may be treated simultaneously with the distilled percarboxylic acid and the peroxide, or first with the distilled percarboxylic acid and then with the peroxide, or first with the peroxide and then with the distilled percarboxylic acid.

In one embodiment the pulp is treated simultaneously with the distilled percarboxylic acid and the peroxide. The pulp is contacted at the same time with the distilled percarboxylic acid and the peroxide.

In other embodiment the pulp is treated with a mixture of the distilled percarboxylic acid and peroxide. The distilled percarboxylic acid and peroxide are mixed together, and then the pulp is contacted with the mixture.

In other embodiment the distilled percarboxylic acid is added first followed by addition of the peroxide. The peroxide is preferably added immediately (without delay) after the addition of the distilled percarboxylic acid.

In other embodiment the peroxide is added first followed by addition of the distilled percarboxylic acid. The distilled percarboxylic acid is preferably added immediately (without delay) after the addition of the peroxide.

The amount of the distilled percarboxylic acid depends, for example on the grade of the distilled percarboxylic acid, amount of the peroxide and/or pulp. In one embodiment the amount of the distilled percarboxylic acid, calculated as 100% distilled percarboxylic acid, is from 0.1 kg to 4 kg per ton of pulp (calculated as dry pulp), preferably from 0.3 kg to 2 kg per ton of pulp (calculated as dry pulp).

The amount of the peroxide depends, for example on the grade of the peroxide, amount of the distilled percarboxylic acid and/or pulp. In one embodiment the amount of the peroxide, calculated as 100% peroxide, is from 0.01 kg to 1 kg per ton of pulp (calculated as dry pulp).

In another embodiment the amount of the peroxide, calculated as 100% peroxide, is 0.01 kg to 0.8 kg per ton of pulp (calculated as dry pulp), preferably from 0.04 kg to 0.6 kg per ton of pulp (calculated as dry pulp), more preferably from 0.06 kg to 0.5 kg per ton of pulp (calculated as dry pulp).

The pulp to be treated may be any suitable pulp. In one embodiment the pulp is wood pulp, preferably chemical pulp. Most preferably the pulp is Kraft pulp.

In one embodiment consistency of the pulp is from 2% to 30%, preferably from 5% to 15%.

The pulp may be treated at any suitable temperature. The pulp is preferably treated at a temperature from 25° C. to 95° C., more preferably from 40° C. to 70° C.

The treatment time may be any suitable time. The pulp is preferably treated for from 30 min to 120 h, more preferably from 1 h to 24 h, and most preferably from 1 h to 6 h.

pH value of the pulp before the treatment may be adjusted by any known method if needed. Preferably pH value of the pulp before the treatment is from 3 to 9, more preferably from 5 to 7.

In one embodiment the step, wherein the pulp is treated, is a post-bleaching step. Preferably the post-bleaching step is the last bleaching step of a bleaching process. Post-bleaching even further raises brightness of pulp. With the process of the present invention brightness drop experienced in post-bleaching is avoided (FIGS. 1-4). In a preferred embodiment brightness of the pulp before the treatment is at least 75% ISO, preferably from 85% to 95% ISO, and more preferably from 85% to 91.5% ISO.

In one preferred embodiment the process comprises a post-bleaching step wherein wood pulp, such as chemical pulp, is treated with distilled peracetic acid (dPAA) and hydrogen peroxide at a temperature of from 25° C. to 95° C., such as from 40° C. to 70° C. for from 1 h to 24 h, such as from 1 h to 6 h. pH value of the pulp prior the treatment is preferably from 3 to 9, such as from 5 to 7. Amount of dPAA is preferably from 0.1 kg to 4 kg per ton of pulp (calculated as dry pulp), such as from 0.3 kg to 2 kg per ton of pulp, and amount of hydrogen peroxide is preferably 0.01 kg to 1 kg per ton of pulp (calculated as dry pulp), such as from 0.06 kg to 0.5 kg per ton of pulp.

In another embodiment distilled peracetic treatment of pulp will induce modifications to the fiber, such as bulk, stiffness, strength properties and cleanliness. Preferably, but not limited to the conditions used for post bleaching, are applicable for achieving the fiber modifications desired.

In yet another embodiment distilled peracetic acid is used for microbiology control of the bleached pulp. Hereby the pulp is disinfected prior to storage, drying or prior to use in paper or board making.

Hereafter, the present invention is described in more detail and specifically with reference to the examples, which are not intended to limit the present invention.

EXAMPLES

Method According to the Present Invention

Treatment, post-bleaching, of pulp was conducted at 10% consistency and at 60° C. The pulps were diluted with deionized water. The dosage of distilled peracetic acid (from Kemira) was 1.5 kg (as 100% dPAA) per ton of pulp (dry pulp). The used dPAA was fresh. The dPAA and hydrogen peroxide concentrations were determined by titration to be 39.16% and 1.04%, respectively. The bleaching pH was set to 6 by addition of NaOH. Bleaching times ranged up to 6 hours. The same bleaching batch was used for all the retention times. A sample was deducted from the pulp at each specific treatment time. The hand-sheets for brightness measurements were prepared by modified ISO standard method. The hand sheets were prepared on a Büchner funnel without excess washing, dried by pressing with 3 bar pressure for 1 min, and thereafter dried in a drum between absorption boards. Hydrogen peroxide (Kemira, 50% w/w) additions into the bleaching were 0.06, 0.1, 0.2 and 0.5 kg (as 100%)/ton of pulp. Hydrogen peroxide and distilled peracetic acid were added one after another without delay.

First reference sample (named "reference") is treated with mere water, and second reference with dPAA (named "1.5 kg dPAA (reference 2)") only.

In Table 1 are presented the used pulps.

TABLE 1

| Pulp | Pulp 1 | Pulp 2 |
|---|---|---|
| Species | Birch Kraft pulp | Birch Kraft pulp |
| Consistency, % | 31.9 | 32.3 |
| Brightness, % ISO | 91.5 | 87.4 |
| Manganese, ppm | 2.8 | NA |
| Iron, ppm | 29 | NA |

Analyses and Results

The standard procedure for measuring the ISO brightness % was modified because some uncertainties were noticed with hand sheet preparation. The darkening of the pulps was visually notable while the ISO brightness values of the hand sheets did not show the darkening phenomenon. Therefore the hand sheets were prepared in a Büchner-funnel, dried by pressing with 3 bar for 1 min and finally drum dried between absorption boards. In this way, the darkening phenomenon could be followed by Brightness measurement of the hand sheets. In other respects, the ISO standard was utilized.

Figure 3:
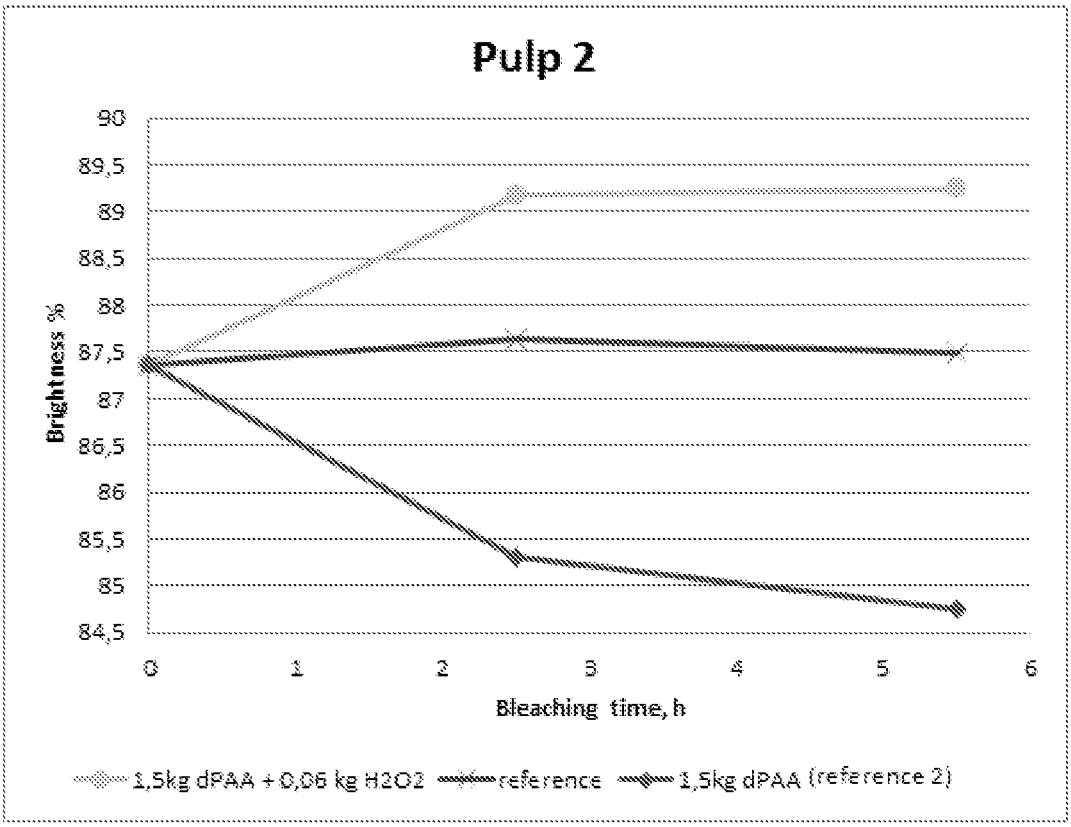
FIG. 3 shows brightness of pulps treated with the method according to the present invention and with reference methods.

The brightness development in the post-bleaching of both Pulp 1 and Pulp 2 is seen to be heavily influenced by the alleged oxidation of manganese at the early stages of the post-bleaching (reference sample(s) in FIG. 1 and FIG. 3). Especially the Pulp 2 is darkened substantially during the first 5 hours of bleaching (FIG. 3, 1.5 kg dPAA (reference 2)).

In FIG. 1 is presented brightness values of Pulp 1 treated with the method of the present invention and reference methods. In FIG. 3 is presented brightness values of Pulp 2 treated with the method of the present invention and reference methods.

Figure 2:
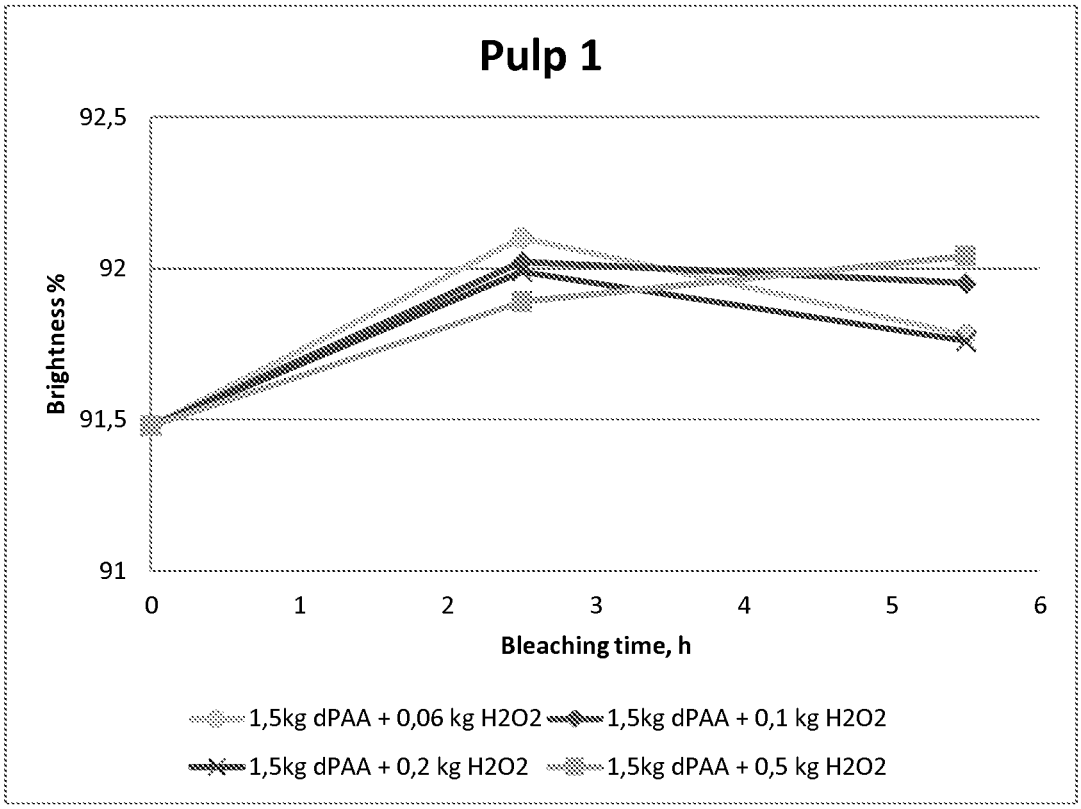
FIG. 2 shows brightness of pulps treated with the method according to the present invention wherein amount of hydrogen peroxide is varied.
Figure 4:
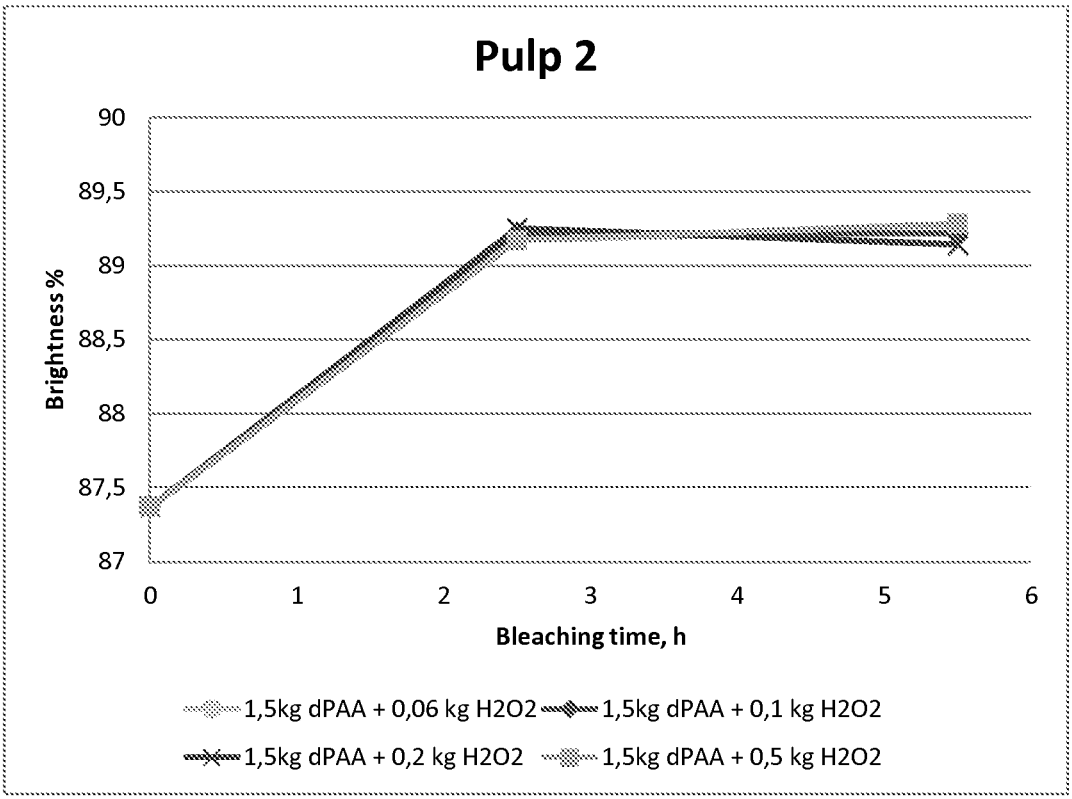
FIG. 4 shows brightness of pulps treated with the method according to the present invention wherein amount of hydrogen peroxide is varied.

It was seen in the tests that peroxide (as 100% peroxide) addition of 0.06 kg/ton of pulp (as dry pulp) was sufficient to prevent the brightness reversion. No extra benefit was observed when increasing the peroxide dosage up to 0.5 kg/ton of pulp (see FIGS. 2 and 4). In FIG. 2 is presented brightness values of Pulp 1 treated with different amount of hydrogen peroxide according to the present invention. In FIG. 4 is presented brightness values of Pulp 2 treated with different amount of hydrogen peroxide according to the present invention.

The invention claimed is:

1. A process for treating pulp comprising subjecting the pulp to a post-bleaching step, wherein the pulp is treated with distilled percarboxylic acid and peroxide, wherein an amount of the peroxide, as 100% peroxide, is from 0.01 kg to 0.8 kg per ton of the pulp (as dry pulp), and wherein brightness of the pulp before the treatment is at least 75% ISO.

2. The process according to claim 1, wherein the distilled percarboxylic acid is distilled performic acid, distilled peracetic acid (dPAA), distilled perpropionic acid, or a mixture thereof.

3. The process according to claim 1, wherein the peroxide is hydrogen peroxide, percarbonate, or a mixture thereof.

4. The process according to claim 1, wherein the pulp is wood pulp, chemical pulp, or Kraft pulp.

5. The process according to claim 1, wherein an amount of the peroxide, as 100% peroxide, is from 0.04 kg to 0.6 kg per ton of pulp (as dry pulp).

6. The process according to claim 1, wherein an amount of the distilled percarboxylic acid, as 100% distilled percarboxylic acid, is from 0.1 kg to 4 kg per ton of pulp (as dry pulp).

7. The process according to claim 1, wherein a consistency of the pulp is from 2% to 30%.

8. The process according to claim 1, wherein the pulp is treated at a temperature from 25° C. to 95° C.

9. The process according to claim 1, wherein a treatment time is from 30 min to 120 h.

10. The process according to claim 1, wherein a brightness of the pulp before the treatment is from 85% to 95% ISO.

11. The process according to claim 1, wherein the distilled per-carboxylic acid and the peroxide are added at the same time.

12. The process according to claim 1, wherein the distilled per-carboxylic acid is added first followed by addition of the peroxide.

13. The process according to claim 1, wherein the peroxide is added first followed by addition of the distilled percarboxylic acid.

14. The process according to claim 1, wherein the distilled per-carboxylic acid and peroxide are added as a mixture.

15. The process according to claim 1, wherein pH value of the pulp before the treatment is from 3 to 9.

16. The process according to claim 1, wherein an amount of the peroxide, as 100% peroxide, is from 0.06 kg to 0.5 kg per ton of pulp (as dry pulp).

17. The process according to claim 1, wherein an amount of the distilled percarboxylic acid, as 100% distilled percarboxylic acid, is from 0.3 kg to 2 kg per ton of pulp (as dry pulp).

18. The process according to claim 1, wherein a consistency of the pulp is from 5% to 15%.

19. The process according to claim 1, wherein the pulp is treated at a temperature from 40° C. to 70° C.

20. The process according to claim 1, wherein a treatment time is from 1 h to 24 h.

* * * * *